US005816125A

United States Patent [19]

Kepert et al.

[11] Patent Number: 5,816,125

[45] Date of Patent: Oct. 6, 1998

[54] METHOD AND APPARATUS FOR REMOVING TRIMMING STRIPS

[75] Inventors: Manfred Kepert, Grosskarlbach; Simon Kostiza, Fussgönnheim, both of Germany

[73] Assignee: Koenig & Bauer-Albert Aktiengesellschaft, Wurzburg, Germany

[21] Appl. No.: 705,147

[22] Filed: Aug. 29, 1996

[30] Foreign Application Priority Data

Aug. 31, 1995 [DE] Germany ..... 195 32 027.1

[51] Int. Cl.[6] ..... B26D 7/06

[52] U.S. Cl. ..... 83/23; 83/27

[58] Field of Search ..... 83/23, 27, 13

[56] References Cited

U.S. PATENT DOCUMENTS 4,305,716 12/1981 Nickum .

FOREIGN PATENT DOCUMENTS

| | | |
|---|---|---|
| 29 31 968 | 7/1981 | Germany . |
| 30 30 705 | 2/1982 | Germany . |
| 28 34 696 | 4/1985 | Germany . |
| 40 23 257 | 12/1993 | Germany . |
| 42 29 699 | 9/1995 | Germany . |
| 6-94334 | 11/1994 | Japan . |

*Primary Examiner*—Maurina T. Rachuba
*Attorney, Agent, or Firm*—Jones, Tuller & Cooper, P.C.

[57] ABSTRACT

In a method and apparatus for the removal of trimming strips located on point needles, it is intended to convey the trimming strips from a cylinder rotating at high rpm, in particular a blade cylinder of a scissors cut device, to a disposal device. This is achieved in an operation in which in that the speared trimming strips are completely pushed off the point needles by stripping fingers acting on them from beneath. The removed trimming strips are supplied to a disposal device.

2 Claims, 5 Drawing Sheets

METHOD AND APPARATUS FOR REMOVING TRIMMING STRIPS

FIELD OF THE INVENTION

The present invention is directed generally to a method and apparatus for removing trimming strips. Most particularly, the present invention is directed to a method and apparatus for removing trimming strips of a printed medium, such as signatures. Most specifically, the present invention is directed to a method and apparatus for removing trimming strips severed from signatures and speared on point needles. The point needles are carried by a cutting blade cylinder which is rotatably supported adjacent a counter cutting blade cylinder that carries the signatures whose perforated ends are to be trimmed off. Once this trimming has been accomplished, the trimming strips are held on the cutting blade cylinder by point needles. These strips are then removed from the point needles by stripping fingers carried by a rotating stripping device that is situated adjacent the cutting blade cylinder and which is rotating at a speed greater than that of the cutting blade cylinder.

DESCRIPTION OF THE PRIOR ART

In the field of rotary, web-fed printing, the initially continuous web is printed as it passes through various printing couples. The printed web is then transversely cut or severed into web segments or sheets that are typically collected into groups of sheets or into so-called signatures. During the cutting of the continuous web into sheets and the collection of the sheets into signatures that are then cross-folded, various point spurs are often used to engage the ends of the sheets. These point spurs create lines of perforations which form somewhat ragged edges on the signatures. While such lines of perforations are acceptable in newspapers and other inexpensive products, they must be eliminated from better and more costly products, such as glossy magazines and the like. This elimination of the perforated edges of the signatures may be done by using a cutting blade cylinder and a cooperating counter cutting blade cylinder which sever the ends of the signatures in a scissors-like blade action but which in the process generate so-called trimming strips. Further treatment of such trimming strips must be done in a manner that does not allow the strips to escape or to hamper the operation of the printing device.

German Patent Publication DE 28 34 696 C2 shows a combined cutting and folding device. In this prior art device, a folding blade spears a trimming strip by means of a point needle section. The trimmed strip is cut from a single printed paper web and is moved, speared in this way, past a rigid stripping device. In the process, the trimmed strip is grasped on the side, pressed against the point spur and finally removed from it.

It is known from the prior art German Patent Publication DE 29 31 968 B1 to use a rotating brush for stripping off cut strips that have been speared on point needles. The bristles of the rotating brushes grasp the trimming strips on their long sides and press them against the point needles so that they are stressed by bending in order to finally strip them off the point needles.

It is further known, as shown in the German Patent Publications DE 40 23 257 C2 and DE 42 29 699 A1 to keep trimmed strips in place by means of suction air and to subsequently push them away from a cutting cylinder by means of compressed air. However, in these prior art devices, the trimmed strips are not held and transported by means of point spurs, so that the problems which are apt to occur in connection with the transport of trimmed strips by means of point spurs are not present in these prior devices.

A smooth cutting device, which consists of a folding jaw cylinder with blades located on its circumference, and of a blade support cylinder, whose blades cooperate in the manner of a scissors to cut off a trimming or waste strip extending transversely to the conveying device from a signature, is shown in the prior art German Patent Publication DE 30 30 705 A1. Each trimming strip is speared by point needles located on the blade support cylinder and is supplied to an aspirating device that is placed downstream in the circumferential direction. In this prior art device, it is disadvantageous in connection with the conveyance of these trimming strips to the aspirating device that the trimmed strips speared on the point needles are apt to prematurely leave the point needles because of a large centrifugal force effect caused by the blade support cylinder rotating at a high rpm. This can result in jams and thus in interruptions in the removal of the trimming strips.

It will thus be seen that a need exists for a method and apparatus for handling trimming strips which overcomes the limitations of these prior art devices. The method and apparatus for removing trimming strips in accordance with the present invention accomplishes this result and is a significant improvement over the prior art.

SUMMARY OF THE INVENTION

It is an object of the present invention to provide a method and apparatus for removing trimming strips.

Another object of the present invention is to provide a method and apparatus for removing trimming strips severed from signatures.

A further object of the present invention is to provide a method and apparatus for removing trimming strips severed from a signature and speared on point needles.

Yet another object of the present invention is to provide a method and an apparatus for the assured removal of trimming strips of printed material from a cylinder rotating at high rpm, in particular from a blade cylinder of a scissors cutting device.

As will be described in detail in the description of the preferred embodiments which are set forth subsequently, the device for severing trimming strips in accordance with the present invention utilizes a cutting blade cylinder that is provided with circumferentially spaced cutting blades and with point needle strips. The cutting blades cooperate with similar cutting blades on a counter-cutting blade cylinder. The signatures, whose ends are to be trimmed, are held in folding jaws on the counter-cutting blade cylinder while their ends are trimmed by the cutting blades on the two cylinders. The resulting trimming strips are engaged by the point needles which are situated adjacent the cutting blades on the cutting blade cylinder. After the trimming strips have been engaged by the point needles, they are then contacted from beneath by stripping fingers that are carried by a rotating stripping device. The stripping device is rotated at a speed greater than that of the cutting blade cylinder so that the plurality of stripping fingers lift each trimming strip off its point needles. The trimming strips which have been lifted off the point needles are then pulled into a disposal chute or duct by the application of a vacuum to the duct.

One of the advantages which can be achieved by the present invention resides in particular in that the trimming strips can be dependably conveyed to a predetermined location, for example a suction device, without leaving the point needles prematurely in the process. The removal of the trimming strips from the specially designed point needles is performed at the provided location by means of rapidly movable ejectors or by compressed air, so that a positionally correct removal of the trimming strips takes place by, for example, supplying them to a disposal device. In this case, trimming strips of lesser width can also dependably be removed. A latticed guide device prevents the trimming strips from being wound around a rotating ejector support. In the course of being stripped off, the trimming strips do not stress the point spurs by bending.

It will be seen that the method and apparatus for removing trimming strips in accordance with the present invention overcomes the limitations of the prior art. It is a substantial advance in the art.

BRIEF DESCRIPTION OF THE DRAWINGS

While the novel features of the method and apparatus for removing trimming strips are set forth with particularity in the appended claims, a full and complete understanding of the present invention may be had by referring to the detailed description of the preferred embodiments which are presented subsequently, and as illustrated in the accompanying drawings, in which:

DETAILED DESCRIPTION OF THE PREFERRED EMBODIMENT

Figure 1:
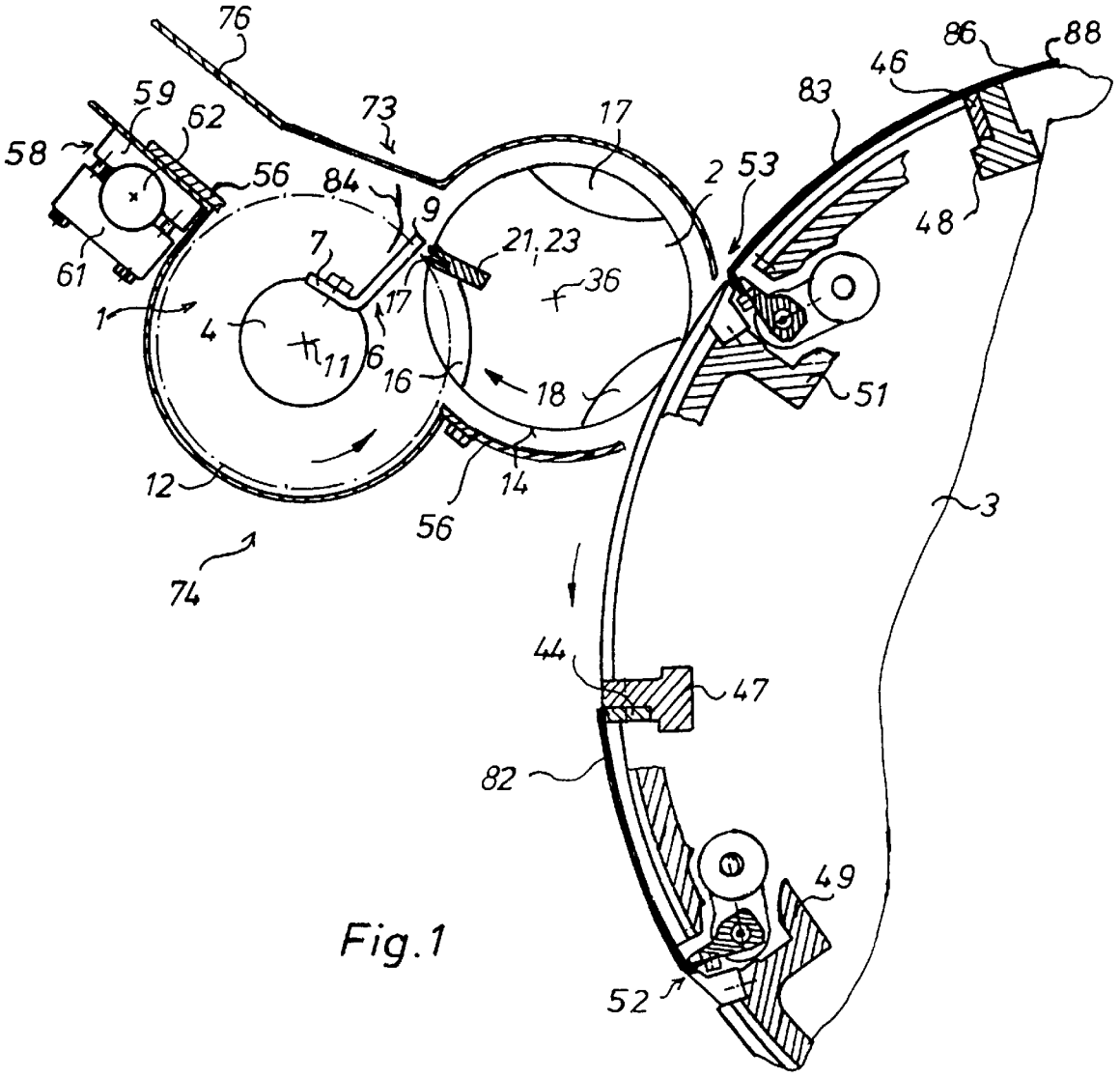
FIG. 1 is a cross sectional view through a first preferred embodiment of a device for removing trimming strips in accordance with the present invention.
Figure 2:
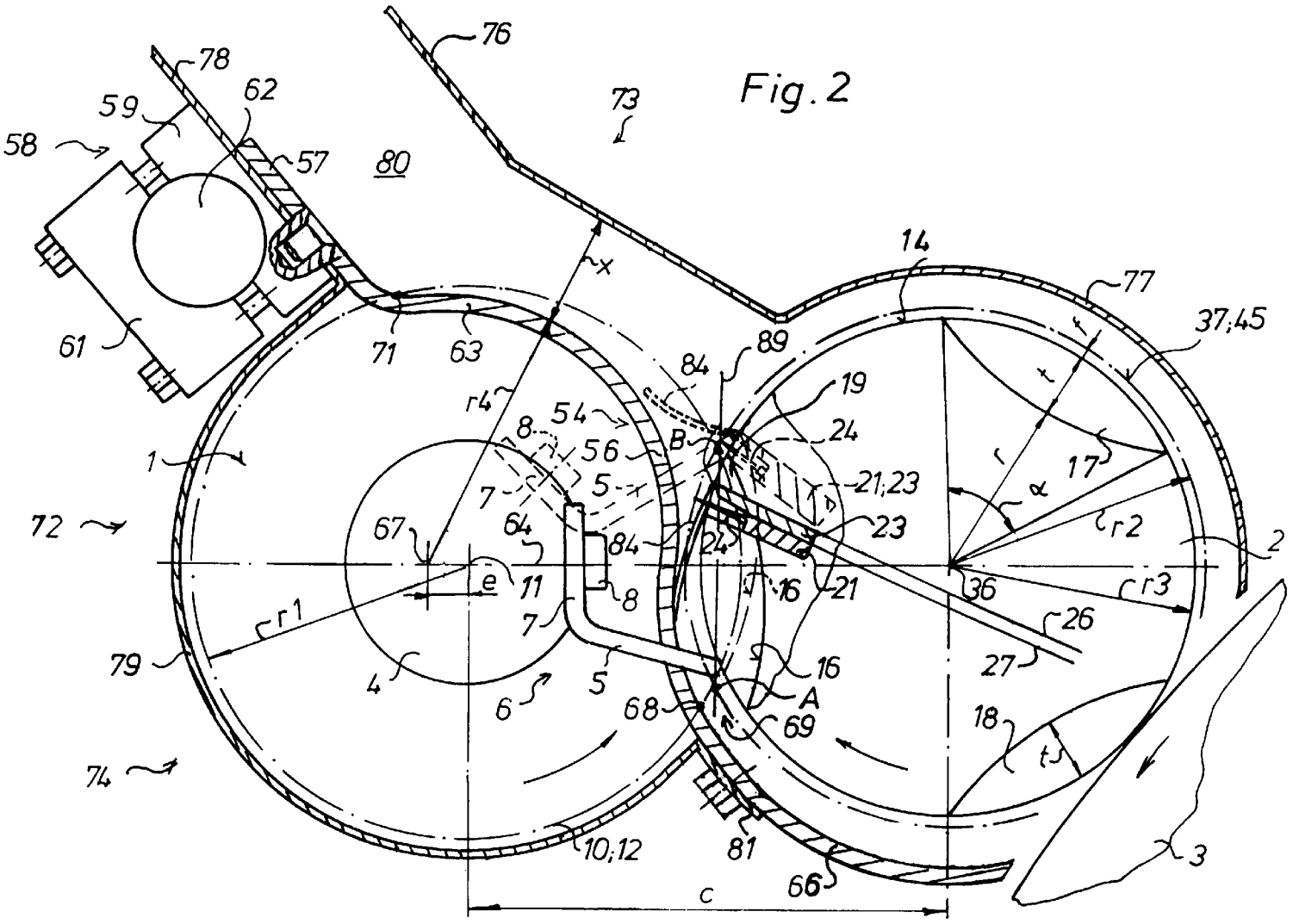
FIG. 2 is a representation of a device in accordance with the present invention with a first preferred embodiment of a cylinder shown in a first working position prior to a stripping step in solid lines, and in a second working position following the stripping step in phantom lines.

Referring initially primarily to FIG. 1, and taken in conjunction with FIG. 2, there may be seen a device for removing trimming strips 84 and 86 of a printed medium, for example paper, speared on point needles 24 of a cutting blade cylinder 2, and which includes a rotating stripping device 1, which cooperates with the upstream located cutting blade cylinder 2. A cutting blade strip 23 of the cutting blade cylinder 2 can cooperate with counter-cutting blades 44 and 46 of a counter-cutting blade cylinder 3 which is also seen in FIG. 1. It will be understood that the counter-cutting blade cylinder 3 is provided with a plurality of circumferentially spaced folding jaws, generally at 52 and 53, and that each of these folding jaws is holding a signature 82 or 83, whose signature end 88 includes the trimming strip 86 that is to be severed from the signature and removed by the trimming strip removal apparatus in accordance with the present invention. It will further be understood that these various cylinders are part of a larger web-fed rotary printing press which is generally conventional and which forms no part of the present invention.

Figure 6:
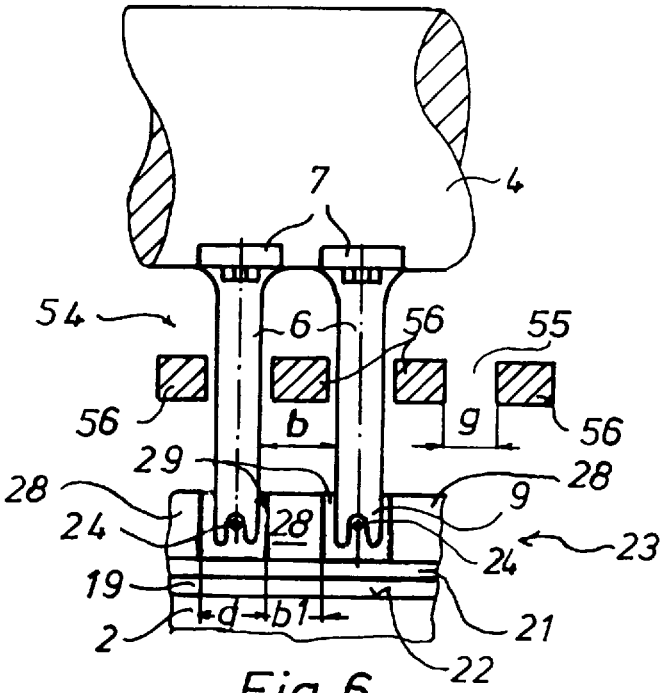
FIG. 6 is a representation of the cooperation of the stripping fingers of the stripping device with a latticed guide device as well as with the point needles of the cylinder.

Again, referring to FIGS. 1 and 2, the rotating stripping device 1 consists of a cylinder-shaped rotating stripping finger support 4, for example a shaft 4, which has a plurality of stripping fingers 6, spaced axially apart from each other at a clear distance "b" from each other, on the circumference of shaft 4 in an axis-parallel direction. The spacing of these individual stripping fingers 6 on the support or shaft 4 may be seen by referring to FIG. 6. Each of the several stripping fingers 6 have an approximately L-shaped form and are fastened, secure against relative rotation, with their bases 7, or their short legs, on a flat space of the shaft 4 by means of screws 8. A free end 9 of a long leg 5 of each of the stripping fingers 6 projects radially outward. The stripping fingers 6 are of equal length and can be made of metal or plastic. The free end 9 of each stripping finger 6 can be embodied to be V-shaped or fork-shaped as seen in FIG. 6 in order to reach around a point needle 24.

During the rotation of the shaft 4 around its longitudinal axis of rotation 11, as seen in FIGS. 1 and 2, the free ends of the stripping fingers 6 respectively move about a circular path 12 of a radius r1 which has its origin on the longitudinal axis of rotation 11. The circular paths 12 of the stripping fingers 6 disposed at a distance next to each other coincide with an envelope surface 10, which also has the radius r1.

In a second preferred embodiment, in place of the above described one-piece stripping fingers 6, two stripping fingers are disposed next to each other, at a slight clear distance from each other, on the shaft 4, so that each stripping finger 6 is embodied in two parts. This slight clear distance is slightly larger than the largest diameter of the point needle 24. Therefore the width of each of the stripping fingers 6 in accordance with this second embodiment can be less, for example half the width of the stripping fingers 6 in accordance with the first preferred embodiment depicted in FIG. 6. During the lifting of the trimming strips 84 and 86, the fork-like free ends 9 of the stripping fingers 6 have a lateral spacing distance from each of the point needles 24. This lateral spacing distance can extend from "just not brushing past or not touching the point needle 24", for example 0.1 mm, to a distance of several millimeters. The fork-like ends 9 of the stripping fingers 6 extend as far as at least one half the diameter of the point needle 24. However, they can be made longer, i.e. greater than the diameter of the point needle 24, in order to prevent the "tearing" of the trimming strips 84, 86 which are being removed from the point needles 24 by the stripping fingers 6.

The cutting blade cylinder 2 is embodied to be solid, for example, and has one or several, for example three in its first embodiment, rows 16, 17, 18 of several axially spaced passage recesses 15 respectively disposed next to each other, with these rows 16, 17 and 18 being evenly distributed on circumference 14 of cylinder 2, and formed at a radius r3 around its longitudinal axis of rotation 36. These several passage recesses 15, which are disposed next to each other, are for receipt of the stripping fingers 6. For example, twenty passage recesses 15 per row 16, 17, 18 are disposed, spaced apart next to each other, in an axis-parallel direction of the cylinder 2. In their position and number the passage recesses 15 correspond with the stripping fingers 6. They "mesh" with them at times and without touching.

Each passage recess is enclosed by a central angle $\alpha$ of, for example, 65° as seen in FIG. 2. The cross section of each passage recess 15 can have any shape, for example a lens or rectangular shape. However, the passage recess 15 or the passage space must have a depth "t", width "d" and length "l" with each such dimension being matched to the respective circular path 12 of the stripping finger 6, so that the stripping finger 6 can respectively pass through the stripping finger passage recess 15 with which it cooperates.

Figure 8:
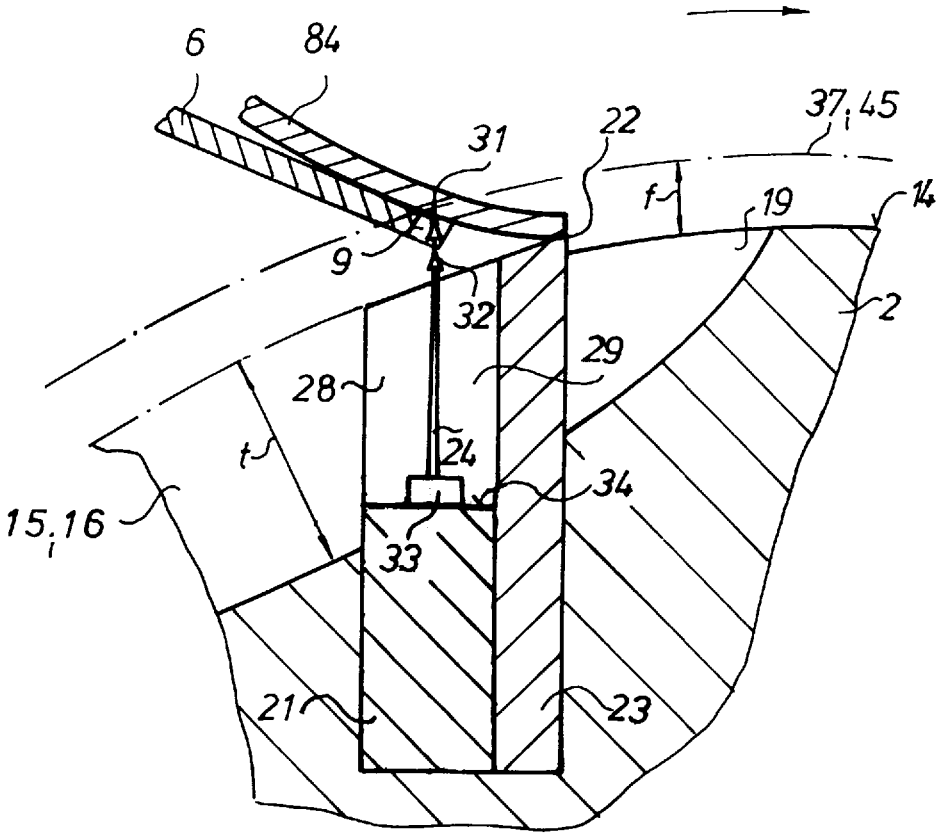
FIG. 8 is a schematic representation of the cross section of a cutting blade with point needles as well as a point of a stripping finger after the finished stripping of a trimming strip.

Referring now primarily to FIG. 8, and viewed in a counter-clockwise direction, the cutting blade cylinder 2 has a cutting blade strip 23 with a cutter edge 22 at the start 19 of, for example the row 16 of passage recesses 15, and which passes through the passage recesses 15. The cutter edge 22 projects a few millimeters, i.e. one to two millimeters, past the circumference 14 of the cylinder 2. In addition, a point needle strip 21, with a row of point needles 24 disposed in a row next to each other, is arranged in such a way with respect to the cutting blade strip 23 that as short as possible a distance from the cutter edge 22 results. The blade strip 23 and the point needle strip 21 extend parallel with each other. In an advantageous manner, the point needle strip 21 may be combined with the cutting blade strip 23. This means that both strips 21 and 23 would be embodied as one piece. By means of this, it is possible to achieve a small distance between the point needle 24 and the cutter edge 22. Both strips 21 and 23 are fastened on the cutting blade cylinder 2 in such a way that the extensions of their upward ordinate axes 26, 27 intersects the circumference 14 of the cylinder 2 as parallel secant, as may be seen by referring to FIG. 2.

Each point needle strip 21 is embodied to be comb-shaped and has tines 28, which are spaced apart at a clear distance "d" from each other over their entire length, as shown in FIGS. 6 and 8. They are used for placing trimming strips 84 and 86 on them. Gaps 29 between the tines 28 are used to each receive one point needle 24 and for the contactless passage of one stripping finger 6. Underneath its tip 31, each point needle 24 has one or several conical "barbs" 32. The point needles 24 are screwed by means of a thread on their base 33 into a threaded bore at the bottom 34 of the gap 29. The tip 31 of each point needle 24 projects past the circumference 14 of the cylinder 2 by an amount "f", for example, two to four millimeters.

A stripping finger 6 is associated with each point needle 24. With each rotation of the cylinder 2 around its longitudinal axis of rotation 36, the tips 31 of the point needles 24 respectively describe a circular path 37 with a radius r2 as seen in FIG. 2, so that a jacket surface 45 as a whole is created. A connecting line 64 through the origins 11, 36 of the circles 12 and 37 with the radii r1 and r2 has a length "c" between the origins 11 and 36. The position of the circles 12, 37 in respect to each other is determined as follows:

$$r2+r1>c>|r1-r2|.$$

An arrangement of the two circles 12 and 37 in accordance with this equation results in that the two circles 12 and 37 have the intersecting points A and B which are shown in FIG. 2. Intersection point A is the point at which the two circles 12 and 37 intersect at convergence. Intersection point B is the point at which the two circles 12 and 37 intersect at divergence with these points A and B of convergence and divergence being taken in respect to the direction of rotation of the cutting blade cylinder 2 and the stripping finger support shaft 4. A secant 89 through the intersection points A and B slices segments 92 and 91 from both circles 12 and 37. The secants of the two segments 91 and 92 formed in this way coincide, so that the touching segments 91 and 92 form a lens-shaped minimum cross section of the required passage space 15 bounded by the generating lines 10 and 45 in the shape of a circle of a cylinder. However, in actuality the passage space is made slightly larger.

In the combined point needle and cutting blade strip 21 and 23, the gaps 29 are open both in the direction toward the circumference 14 as well as in the direction toward the side facing away from the cutting blade strip 23. A "contactless meshing" of the stripping fingers 6 with the point needles 24 is made possible by means of this.

Figure 3:
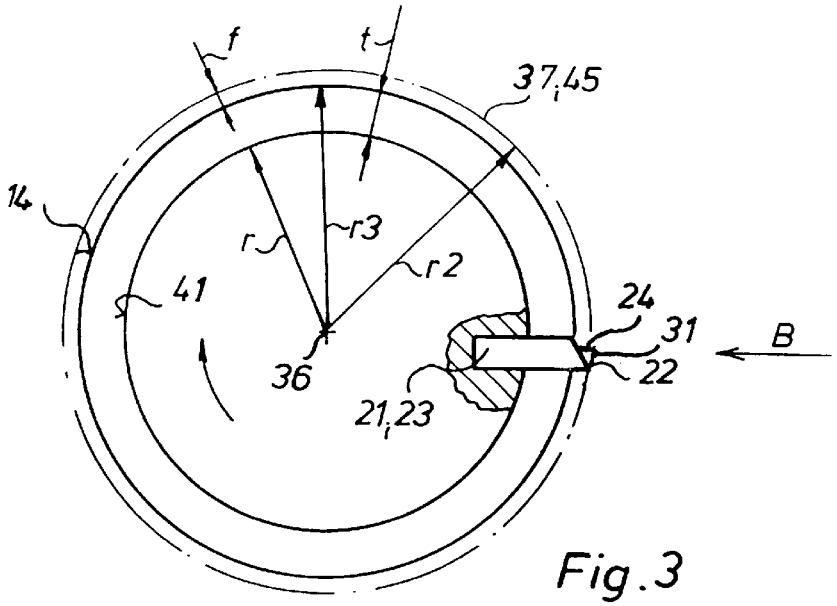
FIG. 3 is a cross sectional view through a cutting cylinder in accordance with a second preferred embodiment.
Figure 4:
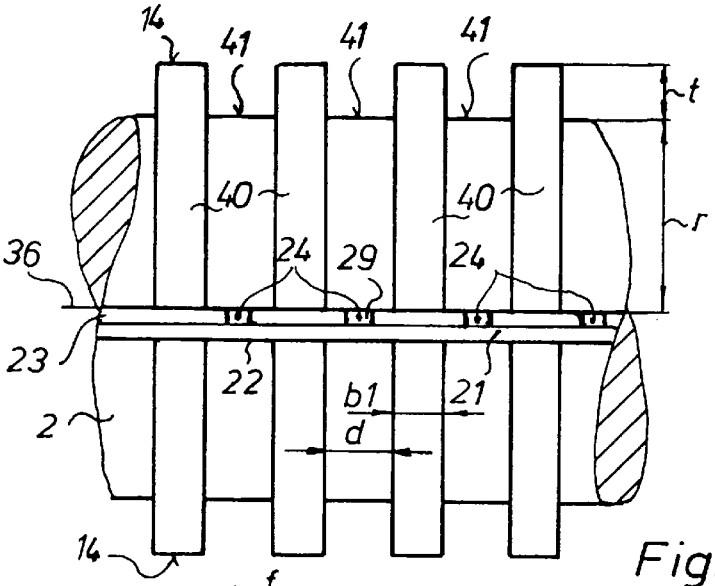
FIG. 4 is a side view taken in the direction indicated by arrow B in accordance with FIG. 3.

In accordance with a second preferred embodiment, as shown in FIGS. 3 and 4, instead of the rows 16, 17, 18 of passage recesses 15 provided with the first preferred embodiment, several spaced rings 40 which provide annular grooves 41 of a depth "t" therebetween, are placed on the cutting blade cylinder 2. The rings 40 and the annular grooves 41 extend coaxially with the longitudinal axis of rotation 36 of the cutting blade cylinder 2 at an outer radius r3 or a radius r. The rings 40 have a width b1 and are disposed at a clear distance "d" from each other. A cutting blade and point needle strip 21 and 23, which has already described above, is attached in the same design and with the same function and position on the cutting blade cylinder 2 in this second preferred embodiment depicted in FIGS. 3 and 4, as it was in the first preferred embodiment depicted in FIGS. 1, 2, and 8.

Figure 5:
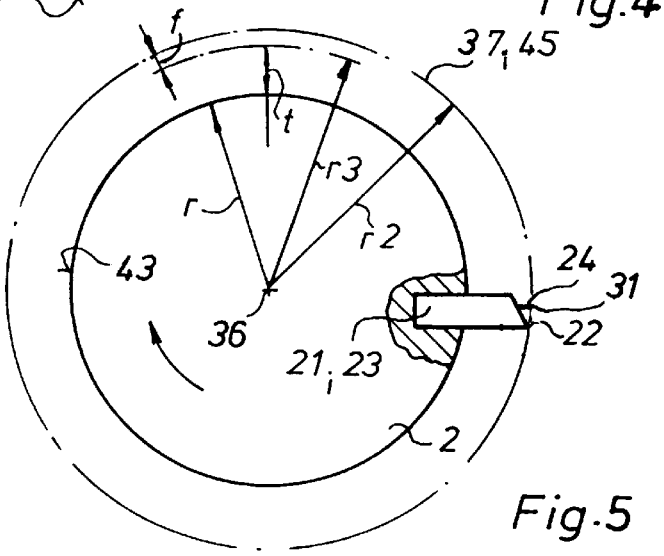
FIG. 5 is a cross sectional view through a cutting cylinder in accordance with a third preferred embodiment.

In a third preferred embodiment of the cutting blade cylinder 2 of the present invention, as may be seen in FIG. 5, the cutting blade and point needle strip 21 and 23 projects past the cylinder surface 43 of cylinder 2 with the radius r by the amount "t". The cutting blade and point needle strip 21 and 23 is designed in the same way as with the second preferred embodiment. All other functions are as described above.

The counter-cutting blade cylinder 3, as may be seen in FIG. 1, has counter-cutting blades 44 and 46 disposed evenly distributed over its circumference and held in counter-cutting blade holders 47 and 48 respectively, which are fixed on the cylinder 3. A so-called "scissors cut" is created by the cooperation of the counter-cutting blades 44 or 46 with the respective cutter edges 22 of the cutting blade strips 21. The counter-cutting blade cylinder 3 is embodied as a combined cylinder. In addition to the counter-cutting blades 44 and 46, cam lever controlled folding jaws 52 and 53 are also provided in a known manner. The number of the folding jaws 52 and 53 and of the counter-cutting blades 44, 46 is equal, for example five each. As is shown in FIG. 1, the folding jaws 52 and 53 receive folded signature 82 and 83 and hold these signatures while their trimming strips 84 and 86, that are situated at the signature ends 88, are cut off by the "scissors cut" discussed above. The resultant trimming strips 84 and 86 are collected or caught by the point needles 24 of the cutting blade cylinder 2 and are removed from the point needles 24 by the stripping fingers 6, as will be described in more detail shortly.

A guide device, generally at 54, for guiding the trimming strips 84 and 86 removed from the point needles 24, is disposed between the cutting blade cylinder 2 and the stripping device 1, as seen in FIGS. 2 and 6. The guide device 54 consists of guide rods 56 which are disposed next to each other at a clear spacing distance "g". The clear spacing distance "g" between the guide rods 56 is of such dimensions here, that the stripping fingers 6 pass contactless between these spaced guide rods 56, as is depicted in FIG. 6. The guide rods 56 are fastened with their first straight end 57 on a holder 58 fixed on the lateral frame as seen in FIG. 2. The holder 58 consists, for example, of clamping elements 59 and 61, which can be respectively screwed to one another and can be clamped in place, spaced apart from each other on a cross bar 62 fixed on a lateral frame. For example, every upper clamping element 59 receives a first straight end 57 of a guide rod 56. The straight end 57 subsequently makes a transition into an approximately semicircular convex bend 63. Curved in this convex manner at the top, the guide rods 56 then travel around the shaft 4 at a distance r4 minus the thickness of the guide rods 56. Starting approximately at a connecting line 64 between the longitudinal axes of rotation 11 and 36, the convex bend of each of the guide rods 56 changes over into a concave bend 66. Curved in this concave way, the guide rods 56 travel around the bottom of the cutting blade cylinder 2 for a short distance and terminate shortly ahead of the counter-cutting blade cylinder 3. The convex bend 63 has an exterior radius r4, whose center of its defining circle 67 is at a distance "e" in respect to the longitudinal axis of rotation 11 of shaft 4 on an extension of the connecting line 64. The axially oriented projection of the circular path 12 and the concave bend 66 intersect in a lower intersection point 68. The latter is located, viewed in the direction of rotation of both devices 1 and 2, shortly ahead of an inlet wedge 69 of the intersection point A of the circular path 12 with the circular path 37. The axially oriented projections of the circular path 12 and the convex bend 63 furthermore intersect in an upper intersection point 71, which is located in the immediate vicinity of the transition from the straight end 57 to the convex bend 63 of the guide rod 56. Both intersection points 68 and 71 are located on a side of the guide device 54 facing away from the shaft 4. Thus, the free ends 9 of the stripping fingers 6 move into the gaps 55 between the guide rods 56, starting at the intersection point 68, and leave it again at the intersection point 71. Because of this, the free ends 9 of the stripping fingers 6 cover a cross-sectional surface respectively between the guide rod 56 and the circular path 12, which has the shape of a crescent moon broken off at the bottom.

The stripping device 1, as well as the cutting blade cylinder 2 are enclosed by a housing 72 which consists generally of an upper housing part 73, a lower housing part 74 and with the associated lateral parts as seen in FIGS. 1 and 2. The upper housing part 73 starts with a left straight part 76 which extends above and which is spaced at a distance "x" above the convex bend 63 of the guide rods 56. A right semicircularly curved unperforated part 77 follows the straight part 76 and extends above and at a slight distance from the circumference 14 of the cylinder 2. This curved part 77 of the upper housing 73 terminates in the immediate vicinity of the counter-cutting blade cylinder 3. The lower unperforated housing part 74 extends from a straight left end 78 via a convex, at least semicircular bend 79, to a right end 81. The right end 81 of the lower housing part 74 is releasably fastened on the guide rods 56 in the vicinity of the cylinder 2. The upper housing part 73 is connected at both sides with the lower housing part 74. At its straight left end 78, the lower housing part 74 is fastened on the holder 58 together with the first ends 57 of the guide rods 56. The left straight part 76 and the left end 78 together with the lateral parts form a chute 80. For the purpose of suctioning off the trimming strips 84 and 86, the chute 80 is connected to the outlet connector of a suction air blower, not shown. This generates a suction force in the chute 80 which will pull trimming strips 84 or 86 away from the cutting blade cylinder 2, as is depicted schematically in FIG. 1.

Figure 7:
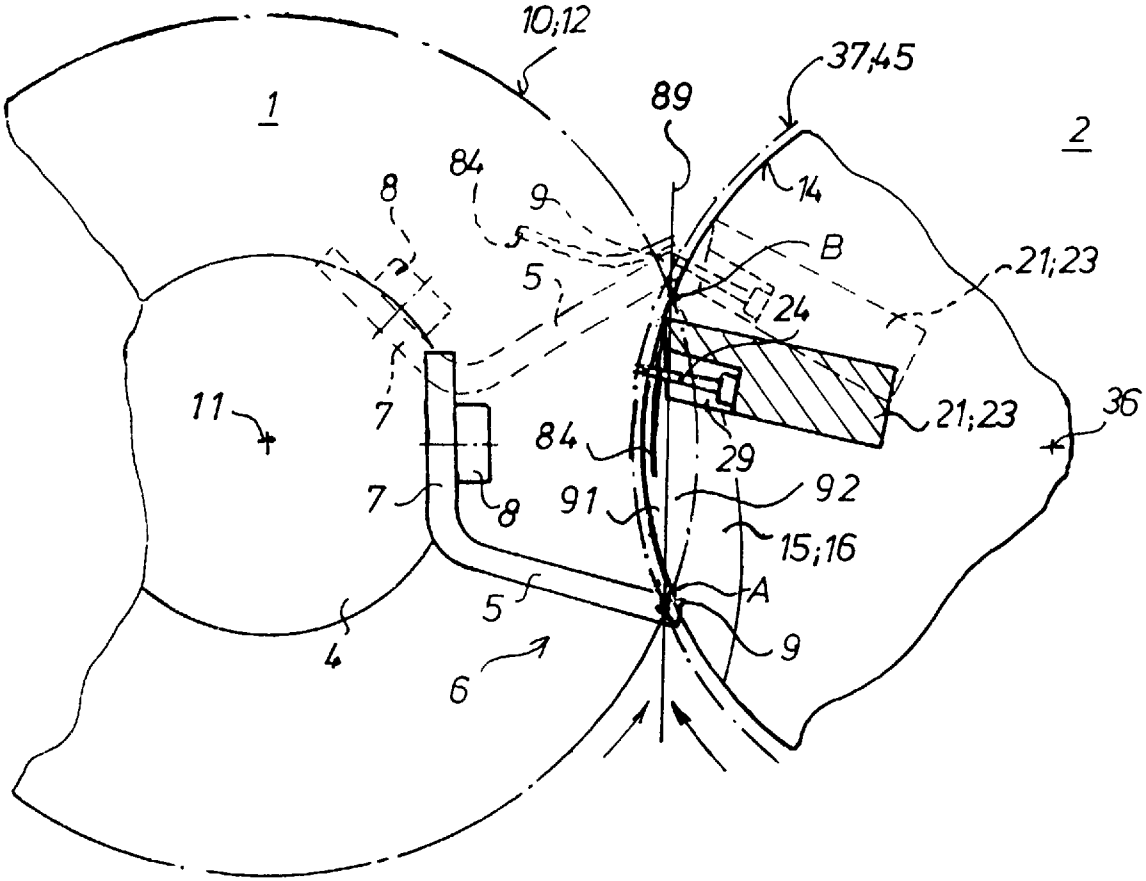
FIG. 7 is a schematic representation of the meshing of the stripping fingers with a concave recess of the cylinder in two working positions.

The operation of the device for recovering trimming strips in accordance with the present invention will now be described in detail. Referring again initially to FIG. 1, it will be seen that the counter-cutting blade cylinder 3 is turning in a counterclockwise direction, for example, and conveys signatures 82 and 83, which are folded in its folding jaws 52 and 53, and which are intended to have their two ends 88, lying on top of each other, cut off. These ends 88 are to be cut off since they have point needle perforations. The end 88 of the signature 83, which projects past the counter-cutting blade 46 and has point needle perforations, is cut off by blade 46 in cooperation with the cutting blade strip 23 on cylinder 2 and is speared practically simultaneously, as the now severed trimming strip 84, by the point needles 24 of the cylinder 2, which is rotating at production speed. On the cylinder 2, which rotates at production speed in a first direction of rotation, the speared trimming strip 84 is carried on its circular path 37, and passes through the first intersection point A of the two intersection points A and B and reaches the segment 91 of the passage space 15, as shown in FIG. 7. While the trimming strip 84 moves between the intersection points A and B of the passage space 15, the stripping finger ends 9 of the stripping fingers 6 pass the intersection point A in a direction of rotation which is opposite to that of the cylinder 2 and reach the segment 92 on the circular path 12. The rotational speed of the stripping finger ends 9 is, for example, three times greater than that of the point needle tips 31, so that the point needles 24 are overtaken by the stripping finger ends 9. In the process, the stripping finger ends 9 move underneath the more slowly moving speared trimming strips 84 that are still in the segment 92. In the process, each fork-shaped end 9 of each of the stripping fingers 6 encloses its associated point needle 24 without touching it. The closest approach of the stripping ends 9 to the point needles 24 is achieved in this state. The stripping finger ends 9 subsequently push the trimming strip 84 off the point needles 24 in the direction toward the point needle tips 31, as seen in the dashed representation in FIGS. 2 and 7. With continued movement, the stripping finger ends 9 leave the segment 92 at the intersection point B. The trimming strip 86 is then pushed off the point needles 24 in this way during the overtaking process. The trimming strip 86 is conveyed by the stripping finger ends 9 along the guide device 54 in the direction toward the suction chute of the disposal unit 80. At the same time, the earlier severed trimming strip 84 is also aspirated by means of suction air applied to the chute 80.

The arrangement of continuous annular grooves 41 in the second embodiment of the cylinder 2, or the use of a cylinder with a smaller radius r in the third embodiment, makes it possible for the stripping device to have a different circumferential speed. For example, the circumferential speed of the stripping device 1 can be 2.5 times the circumferential speed of the cylinder 2. However, in this case it becomes necessary to provide an additional stripping finger, respectively offset by 180° in respect to the first stripping finger 6, on the shaft 4. In this case, a synchronization between the ends 9 of the stripping fingers 6 and the point needles 24 must always be provided to insure that the trimming strips 84 and 86 are pushed off the point needles 24.

The cylinder 2 as well as the stripping device 1 can be driven by the counter-cutting blade cylinder 3 via known gear wheels. The stripping device 1 as well as the cylinders 2 and 3 are rotatably seated in lateral frames, not shown.

In place of the stripping device 1 it is also possible to arrange air nozzles oriented in their longitudinal direction in the vicinity of the point needles 24, for example at their base 33. These air nozzles will be provided with timed bursts of air under pressure at the proper moment so that the trimming strips 84 and 86 can be pushed off the point needles 24 by the air under pressure.

While preferred embodiments of a method and apparatus for removing trimming strips from signatures in a rotary printing press in accordance with the present invention have been set forth fully and completely hereinabove, it will be apparent to one of skill in the art that a number of changes in, for example, the type of printing press used, the overall size of the cylinders, the drive arrangements for the cylinders and the like can be made without departing from the true spirit and scope of the present invention which is accordingly to be limited only by the following claims.

What is claimed is:

1. A method for removing trimming strips from a printed medium including the steps of:

providing a rotating cutting blade cylinder;

locating cutting blades on said cutting blade cylinder;

locating point needles on said cutting blade cylinder adjacent said cutting blades;

providing a rotating counter-cutting cylinder having counter-cutting blades adjacent said cutting blade cylinder;

feeding a folded printed medium to said counter-cutting cylinder;

severing trimming strips from a trailing end of said folded printed medium using said cutting blades and said counter-cutting blades;

spearing said severed trimming strips on said point needles of said cutting blade cylinder;

positioning a rotating stripping device adjacent said cutting blade cylinder;

providing a plurality of spaced stripping fingers on said rotating stripping device;

engaging said severed trimming strips on said cutting blade cylinder with said stripping fingers on said rotating stripping device;

removing said speared trimming strips from said point needles by said engaging of said trimming strips with said spaced stripping fingers on said rotating stripping device; and directing said removed trimming strips to a disposal device.

2. The method of claim 1 further including providing generally lens-shaped passage spaces in said cutting blade cylinder, and passing said stripping fingers though said lens-shaped passage spaces while said point needles are supporting said trimming strips for said removing of said trimming strips from said point needles.

* * * * *